US010745165B2

(12) United States Patent
Nakai

(10) Patent No.: US 10,745,165 B2
(45) Date of Patent: Aug. 18, 2020

(54) METHOD AND DEVICE FOR CRUSHING AND DISCHARGING GRANULAR CLUMP MATERIAL IN FLEXIBLE CONTAINER

(71) Applicant: BRIDGESTONE CORPORATION, Tokyo (JP)

(72) Inventor: Yuuki Nakai, Tokyo (JP)

(73) Assignee: BRIDGESTONE CORPORATION, Tokyo (JP)

( * ) Notice: Subject to any disclaimer, the term of this patent is extended or adjusted under 35 U.S.C. 154(b) by 1168 days.

(21) Appl. No.: 14/902,675

(22) PCT Filed: Jun. 19, 2014

(86) PCT No.: PCT/JP2014/066356
§ 371 (c)(1),
(2) Date: Jan. 4, 2016

(87) PCT Pub. No.: WO2015/001983
PCT Pub. Date: Jan. 8, 2015

(65) Prior Publication Data

US 2016/0167819 A1 Jun. 16, 2016

(30) Foreign Application Priority Data

Jul. 3, 2013 (JP) ..... 2013-139723

(51) Int. Cl.
*B02C 1/00* (2006.01)
*B65B 69/00* (2006.01)
*B65B 39/00* (2006.01)

(52) U.S. Cl.
CPC ..... *B65B 69/0083* (2013.01); *B02C 1/00* (2013.01); *B02C 1/005* (2013.01); *B65B 39/001* (2013.01)

(58) Field of Classification Search
CPC ..... B65B 69/0083; B65B 39/001; B02C 1/00; B02C 1/005
(Continued)

(56) References Cited

U.S. PATENT DOCUMENTS 2,858,051 A * 10/1958 Cunningham ..... B65B 69/0083 222/103
5,033,706 A * 7/1991 Poulton ..... B65D 90/205 222/105
(Continued)

FOREIGN PATENT DOCUMENTS

| | | | |
|---|---|---|---|
| CN | 101318896 | A | 12/2008 |
| GB | 2 439 945 | A | 1/2008 |
| JP | 2004089927 | A | 3/2004 |

OTHER PUBLICATIONS

Sep. 30, 2014 International Search Report issued in International Patent Application No. PCT/JP2014/066356.
(Continued)

*Primary Examiner* — Shelley M Self
*Assistant Examiner* — Smith Oberto Bapthelus
(74) *Attorney, Agent, or Firm* — Oliff PLC

(57) ABSTRACT

The device and method for crushing and discharging a granular clump material in a flexible container includes a hanging step for hanging from above a flexible container containing a compacted granular clump material, a thrusting step for thrusting top portions of contact units against a bottom wall of the flexible container in regions on opposite sides of a discharge tube extending downward from a central region of the bottom wall, and a pushing step for pushing side portions of the contact units in regions from the bottom wall to side portions of the flexible container. The method and device are capable of crushing the granular clump
(Continued)

material in the flexible container and of discharging substantially whole amount thereof.

2 Claims, 7 Drawing Sheets

(58) Field of Classification Search
USPC ..... 241/30
See application file for complete search history.

(56) References Cited

U.S. PATENT DOCUMENTS 5,184,759 A * 2/1993 Gill ..... B65B 69/0083 222/181.3
5,699,730 A * 12/1997 Ogier ..... B65B 69/0091 100/233
5,788,449 A * 8/1998 Riemersma ..... B65B 69/0091 222/103
6,149,110 A * 11/2000 Gill ..... B65B 43/54 141/114
6,186,360 B1 * 2/2001 Becker ..... B65B 69/0091 222/1
6,290,098 B1 * 9/2001 Sterner ..... B65B 69/0075 222/105
6,354,784 B1 * 3/2002 Farr ..... B65B 5/108 206/386
7,159,744 B2 * 1/2007 Sterner ..... B65B 69/0083 222/196
7,223,058 B2 * 5/2007 Nyhof ..... B65B 69/0091 414/415
7,845,600 B2 * 12/2010 Kosich ..... B65D 88/1668 248/95
8,181,568 B1 * 5/2012 Hofman ..... B01F 11/0065 100/233
9,254,935 B2 * 2/2016 Mothersbaugh .... B65B 69/0083
9,365,405 B2 * 6/2016 Stratton ..... B67D 1/0021
9,387,950 B2 * 7/2016 Hofman ..... B65B 69/0091
2003/0206790 A1 * 11/2003 Nyhof ..... B65B 69/0091 414/415
2005/0199650 A1 * 9/2005 Nyhof ..... B65B 69/0091 222/105
2009/0010573 A1 * 1/2009 Kosich ..... B65D 88/1668 383/22
2012/0063259 A1 * 3/2012 Fujiyama ..... B29B 7/42 366/69
2016/0167819 A1 * 6/2016 Nakai ..... B02C 1/005 241/30

OTHER PUBLICATIONS

Jun. 27, 2016 Extended European Search Report issued in European Patent Application No. 14819434.3.

* cited by examiner

METHOD AND DEVICE FOR CRUSHING AND DISCHARGING GRANULAR CLUMP MATERIAL IN FLEXIBLE CONTAINER

TECHNICAL FIELD

The present invention relates to a method and a device for crushing and discharging a granular clump material, which has solidified in a flexible container, as a bag container used for transporting and storing the granular clump material.

BACKGROUND ART

In order to effectively transport and store a granular clump material in a flexible container, the granular clump material is compacted and solidified in the container.

The granular clump material in the form of a compacted and solidified mass in the container cannot be taken out as it is, from within the container through a discharge tube of small diameter of the container. It is therefore required to brake or crush the granular clump material.

A device for crushing and discharging such a granular clump material in a container has already been proposed (For example, refer to Patent Document 1).

PRIOR ART DOCUMENT

Patent Document

Patent Document 1: JP 2004-89927 A

In the crushing and discharging device disclosed in Patent Document 1, a flexible container containing a granular clump material is put in a frame along a vertical reception plate, and a planar plate is provided such that the flexible container is located between the vertical reception plate and the planar plate. The planar plate is attached to free ends of rods of upper and lower cylinders. The planar plate is adapted to be advanced and retracted in an attitude inclined relative to vertical direction by independent operations of the upper and lower cylinders.

To carry out crushing operation, an upper portion of the planar plate is thrust against a lateral part of an upper portion of the flexible container by the operation of the upper cylinder, so as to compact and crush an upper portion of the granular clump material in the flexible container put between the reception plate and the planar plate. Then, a lower portion of the planar plate is thrust against a lateral part of a lower portion of the flexible container by the operation of the lower cylinder, so as to initiate compaction and crushing of the granular clump material in the flexible container between the reception plate and the planar plate. By the operation of the lower cylinder, a lower portion or a part of the granular clump material is thrusted upward, accompanied by crushing operation.

The thus crushed granular clump material is discharged by opening a bottom opening of the flexible container.

DISCLOSURE OF THE INVENTION

Problem to be Solved by the Invention

After the granular clump material in the flexible container has been crushed by operating the upper and lower cylinders to move the planar plate toward the reception plate to compact the flexible container located between the planar plate and the reception plate, the shape of the flexible container tends to be retained as it is after the compaction.

For this reason, even if the same compacting operation were carried out repetitively, a good crushing effect cannot be obtained.

Therefore, in case the above crushing operation has been carried out but non-crushed material partly remains in the container, it was difficult to crush the remaining non-crushed material.

The flexible container used with the crushing and discharging device disclosed in Patent Document 1 is of a cylindrical shape. In case the flexible container were of a rectangular shape, it is not easy for the device disclosed in Patent Document 1 to discharge crushed material remaining in the four corners of the flexible container through a bottom opening of the container.

The present invention has been made in view of the above problems, and it is the object of the present invention to provide a method and a device for crushing and discharging a granular clump material, which has solidified in a flexible container, wherein the granular clump material in the flexible container can be effectively crushed and almost entire amount of the crushed granular clump material can be discharged.

Means for Solving the Problem

To attain the above object, the present invention provides a method for crushing and discharging a granular clump material comprising the steps of: hanging down a flexible container containing the granular clump material; thrusting top portions of contact units against a bottom wall of the flexible container, which has a discharge tube extending downward from a central region of the bottom wall, in regions of the bottom wall on opposite sides of the discharge tube; and pressing side portions of the contact units onto portions of the flexible container in regions from the bottom wall to sides of the flexible container.

In a preferred embodiment of the invention, the thrusting step and the pressing step are performed repetitively a plurality of times.

The present invention also provides a device for crushing and discharging a granular clump material comprising: a hanger for hanging down a flexible container containing the granular clump material therein and having a discharge tube extending downward from a central region of a bottom wall of the container; pairs of opposite contact units arranged in a symmetrically swingable manner below the flexible container hung by the hanger, the contact units having top portions shiftable between closed and opened positions; a swing mechanism for causing swinging movement of the contact units; a lift table supporting the contact units and the swing mechanism thereon; and a lift mechanism for raising and lowering the lift table.

In a preferred embodiment of the invention, the pairs of opposite contact units have vertically erected attitudes in which the top portions thereof are in the closed positions, the contact units being disposed at such positions that the top portions thereof are thrust against the bottom wall of the flexible container in regions on opposite sides of the discharge tube, when the contact units are raised in the vertically erected attitudes.

In a further preferred embodiment of the invention, the pairs of contact units include a pair of left and right contact units and a pair of front and rear contact units.

Effect of the Invention

According to the method for crushing and discharging a granular clump material in a flexible container in the present invention, the thrusting of the top portions of the contact units against the bottom wall of the flexible container in regions of the bottom wall on opposite sides of the discharge tube, in the thrusting step, causes the compressed granular clump material in the container to be cracked so as to be disintegrated. Consequently, central mass portion of the cracked and disintegrated granular clump material is caused to fall and flow by gravity through the discharge tube in the center of the bottom wall of the flexible container and is discharged from the container. Thereafter, by carrying out the pressing step, the side portions of the contact units are pressed onto portions of the flexible container in regions from the bottom wall to the sides of the flexible container, so that the flexible container is squeezed in such a manner that material masses remaining in the peripheral regions of the container are forced to move to the central region of the container thereby to be discharged through the discharge tube provided in the central region of the bottom wall.

The granular clump material mass in the flexible container can thus be disintegrated and discharged substantially entirely from the container.

According to the preferred embodiment of the invention, the thrusting step and the pressing step are performed repetitively a plurality of times, whereby it is ensured that granular clump material mass in the flexible container is disintegrated entirely and be fully discharged from the container.

According to the device for crushing and discharging a granular clump material in the present invention, there are provided a hanger for hanging down a flexible container containing a granular clump material therein and having a downwardly extendable discharge tube extending downward from a central region of a bottom wall of the container, pairs of opposite contact units arranged in a symmetrically swingable manner below the flexible container hung by the hanger, the contact units having top portions shiftable between closed and opened positions, a swing mechanism for causing swinging movement of the contact units, and a lift mechanism for raising and lowering a lift table supporting the contact units and the swing mechanism thereon. Consequently, when the upwardly directed top portions of the pairs of opposite contact units are raised and thrust against the container bottom walls by the operation of the lift mechanism, the compressed granular clump material in the flexible container hung down by the hanger is subjected to thrusting forces and disintegrated due to cracks produced by the thrusting forces, and central mass portion of the cracked and disintegrated granular clump material is caused to fall and flow down by gravity through the discharge tube in the center of the bottom wall of the flexible container and is discharged from the container. Thereafter, when the pairs of the contact units in oblique attitude or in inclined opened state are raised by the lift mechanism while the contact units are being changed in attitude from the inclined opened state to erected state, side portions of the contact units are pressed onto portions of the flexible container in regions from the bottom wall to the sides of the container, so that the flexible container is squeezed in such a manner that material masses remaining in the peripheral regions of the container are forced to move to the central region of the container, thereby to be discharged through the discharge tube in the central region of the bottom wall.

The granular clump material mass in the flexible container can thus be disintegrated and be discharged substantially entirely from the container.

According to a preferred embodiment of the invention, when the pairs of opposite contact units are raised in the vertically erected attitudes in which the top portions thereof are in the closed positions, the top portions of the contact units are thrust against the bottom wall of the flexible container in regions on opposite sides of the discharge tube. Consequently, the granular clump material in the flexible container is cracked in the regions on the opposite sides of the discharge tube connected to the bottom wall. The cracks thus produced develop with resultant disintegration of the granular clump material, whereby central mass portion of the cracked and disintegrated granular clump material falls and flows down by gravity through the discharge tube in the center of the bottom wall of the container to be easily discharged through the discharge tube.

According to a preferred embodiment of the invention, the pairs of contact units are made up of a pair of left and right contact units and a pair of front and rear contact units. When the two pairs of the contact units in the erected attitudes are raised and thrust at their top portions against the bottom wall of the flexible container, the granular clump material in the flexible container is cracked in the regions on opposite sides of the discharge tube connected to the bottom wall, and the cracks thus produced develop rapidly with resultant disintegration of central mass portion of the cracked granular clump material, which falls through the discharge tube in the center of the container bottom wall to be discharged in an easy way.

BEST MODE FOR CARRYING OUT THE INVENTION

A preferred embodiment of the present invention will be described with reference to FIGS. 1 to 13.

A device 1 for crushing and discharging a granular clump material according to an embodiment of the invention has a lift table 5 supported on upwardly extending cylinder rods 3*r* of four air cylinders 3, which are arranged on a table feeder 2.

Figure 5:
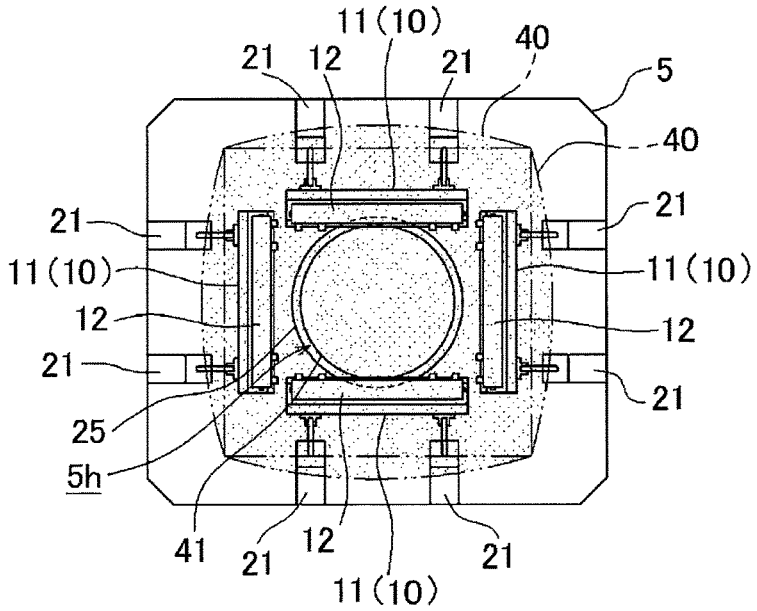
FIG. 5 is a plan view of the device for crushing and discharging a granular clump material in an operational stage in which the flexible container is hung down and the crushing operation is about to be carried out.
Figure 6:
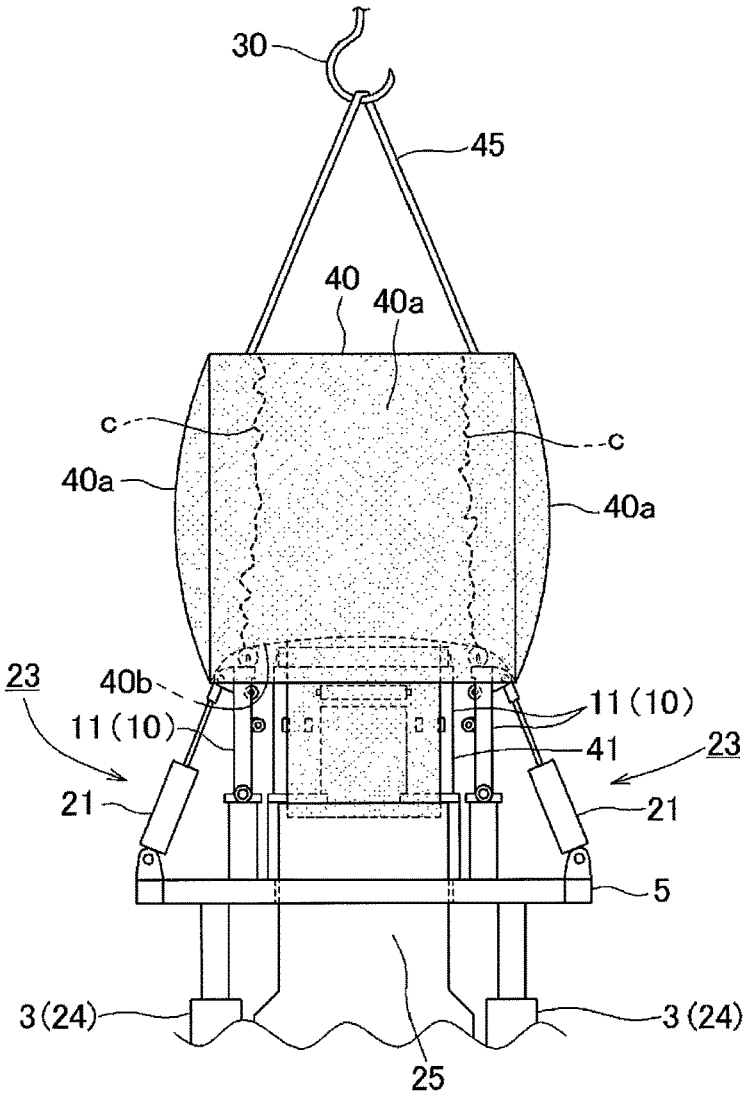
FIG. 6 is a front view of the device for crushing and discharging a granular clump material in a thrusting stage.

Referring to FIG. 5, the lift table 5 is of a rectangular shape and has a circular opening 5*h* at the center.

Figure 1:
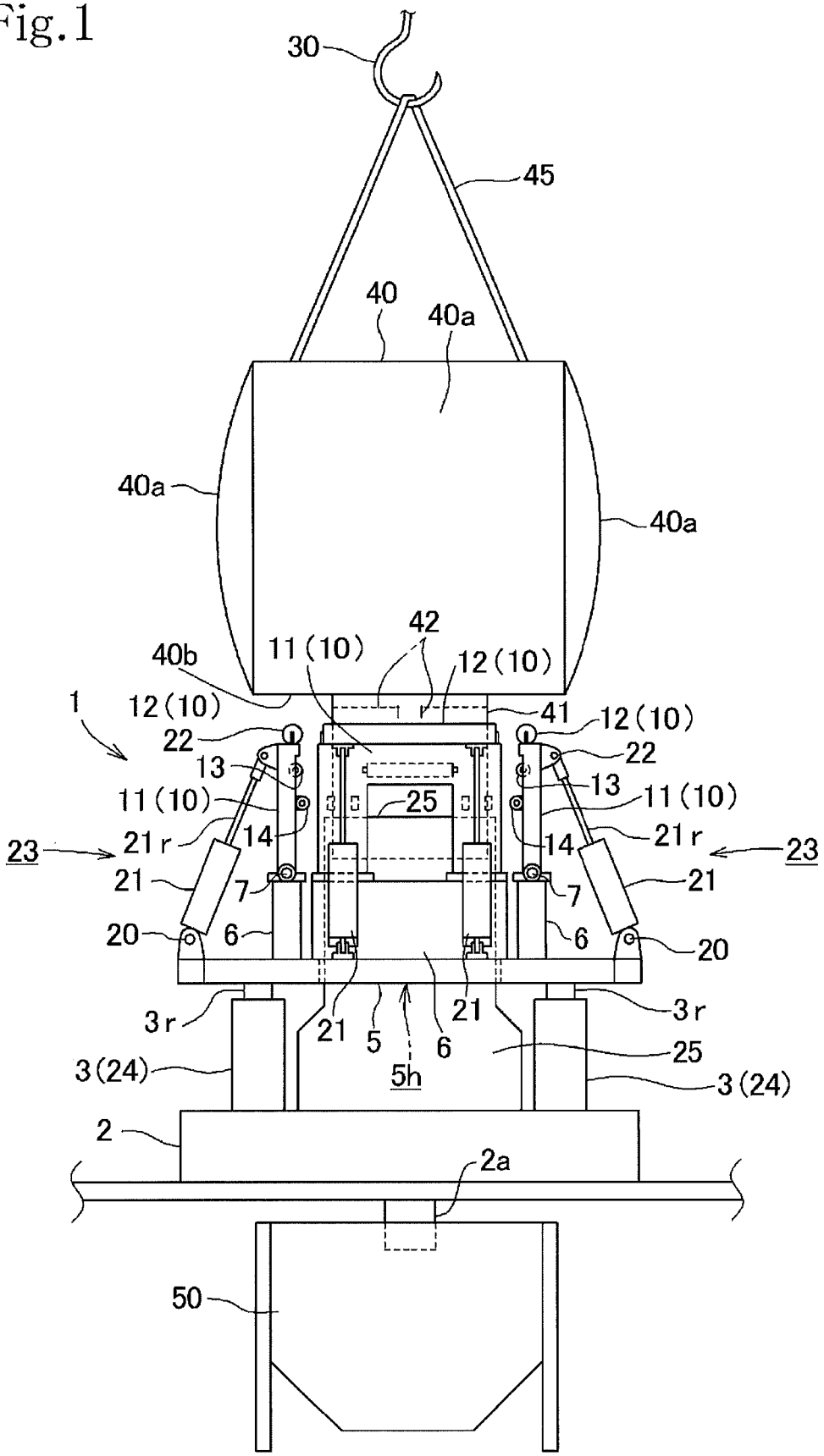
FIG. 1 is a front view showing the device for crushing and discharging a granular clump material according to the present invention and a flexible container hung down by a hook.

Referring to FIG. 1, the hollow rectangular lift table 5 is adapted to be elevated and lowered by the operation of the air cylinders 3 as a lift mechanism 24, maintaining a horizontal attitude in which the four sides of the table 5 are oriented perpendicular to and parallel to the sheet of the figure.

Four vertical walls 6 are erected on the lift table 5 so as to surround the central circular opening 5*h* of the table 5 and in an arrangement parallel to the four sides of the table 5. A swingable contact unit 10 is provided on each of the vertical walls 6 with the lower end of the contact unit 10 pivotally mounted on each the vertical wall 6.

Figure 2:
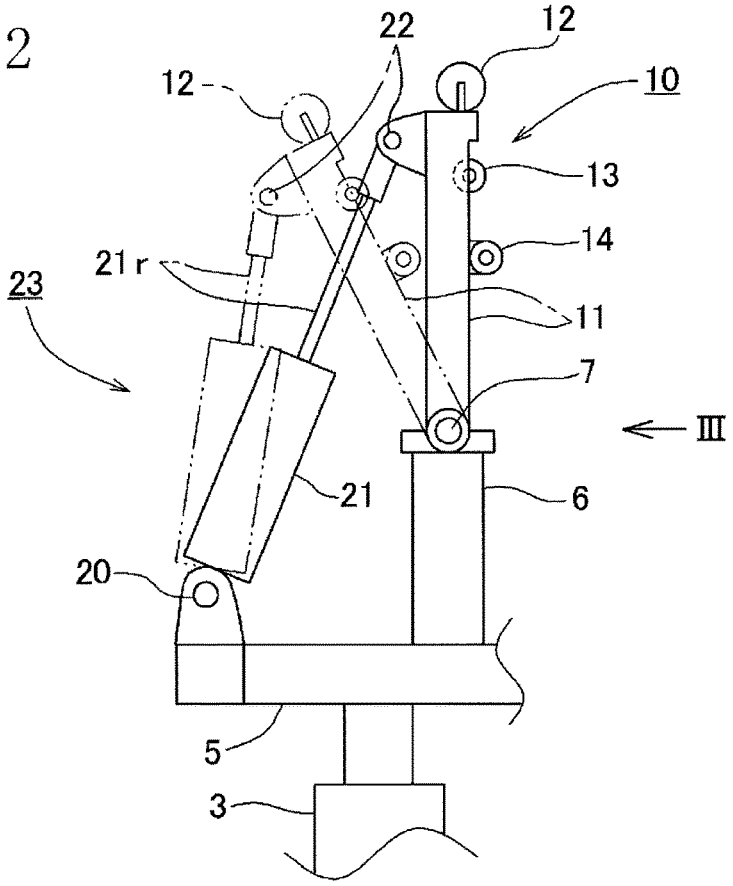
FIG. 2 is a side view of a contact unit.
Figure 3:
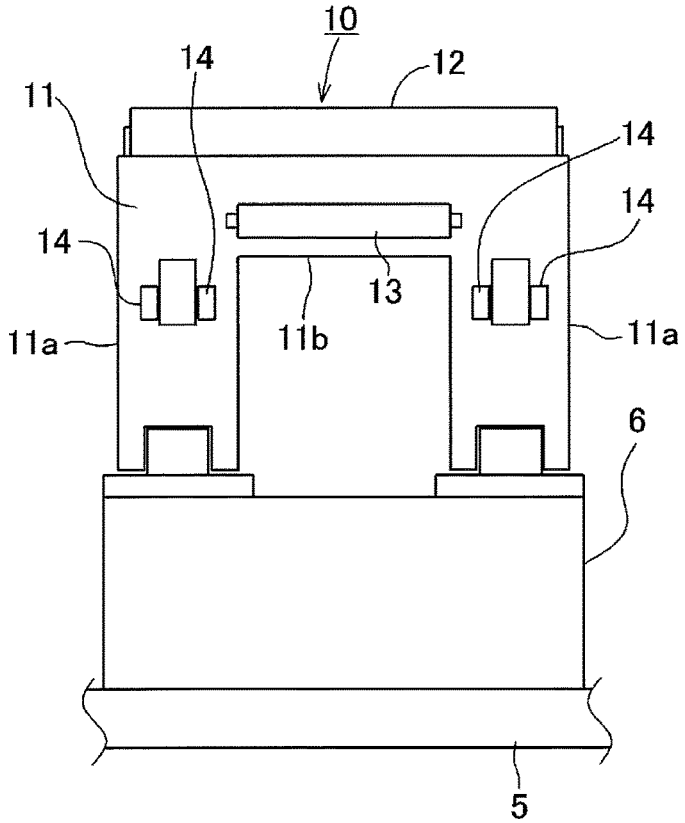
FIG. 3 is an inside elevational view of the contact unit (as viewed in the direction of III in FIG. 2)

With reference to FIGS. 2 and 3, each of the contact unit 10 includes a swing plate 11 made up of a pair of side portions 11*a* having lower ends mounted by pivot pins 7 on the vertical wall 6, and a horizontal portion 11*b* connecting the upper free ends of the side portions 11*a*. The horizontal portion 11*b* of the swing plate 11 has a thrusting rod 12 of elongated, circular cylindrical shape attached horizontally on the top surface of the horizontal portion 11*b*. An elongated pressing roller 13 of circular cylindrical shape is supported horizontally on a horizontally intermediate region of the inside surface of the horizontal portion 11*b*. A pair of short pressing rollers 14 are supported horizontally on the inside surface of each of the side portions 11*a*.

The thrusting rod 12 is disposed at the highest position, the elongated pressing roller 13 at an intermediate position, and the short pressing rollers 14 at the lowest positions.

On the lift table 5 are provided two air cylinders 21 in side-by-side disposition on the outside of each of the four vertical walls 6 in rectangular arrangement.

Each of the air cylinders 21 has its lower end supported by a pivot pin 20 on the lift table 5 so as to be swingable, while a cylinder rod 21*r* extending upward from within each of the air cylinders 21 has a free end thereof connected by a pivot pin 22 to the outer wall of the swing plate 11.

When the cylinder rod 21*r* of the air cylinder 21 moves fully upward, the swing plate 11 (contact unit 10) is caused to be erected vertically as indicated in solid line in FIG. 2, while when the cylinder rod 21*r* is retracted into the cylinder, the swing plate 11 (contact unit 10) is caused to obliquely incline to the outside as indicated in chain line in FIG. 2, so that the upper edge of the swing plate 11 is shifted to the outside. Thus, each of the contact units 10 is adapted to swing about the pivot pins 7 by means of a swing mechanism 23 including the pivot pins 20, the air cylinders 21 and the pivot pins 22.

As will be understood, the sets of one contact unit 10 and the air cylinders 21 are arranged in the front, rear, left and right sides of the lift table 5 in mutually symmetrical arrangement.

The contact units 10 in the front and rear sides are concurrently moved in unison to take the vertical and inclined attitudes, which are closed and opened attitudes, respectively. In the vertical or closed attitude, the front and rear contact units 10 are erected in mutually parallel relation, while, in the inclined or opened attitude, the front and rear contact units 10 are in a relation wherein the upper edges thereof are shifted outward apart from each other.

A similar relation exists for the left and right side contact units 10.

A circular-cylindrical hopper 25 extends from below through the central circular opening 5*h* of the lift table 5.

Below the lift table 5, the hopper 25 has a portion expanding in diameter, which is connected to the table feeder 2.

A hook 30 is provided above the swingable contact units 10, to serve as a hanger for hanging a flexible container 40 containing a granular clump material. As shown, the flexible container 40 is hung down by the hook 30.

The flexible container 40 is a rectangular bag container which can be deformed flexibly. The material in the flexible container 40 is compacted and solidified to reduce its volume for efficient transportation and storage thereof.

In the preferred embodiment of the invention, zinc oxide material in granular clump state is supposed to be used, but any material other than zinc oxide, which can be solidified when compacted, can be used under the principle of the invention.

It is preferred that the flexible container is in the form of a rectangular bag. A rectangular bag is more efficient in the use of the material-containing space for transportation and storage, than a cylindrical bag.

Referring to FIG. 1, the flexible container 40 has front, rear, left and right sides 40*a*, and an upper rectangular opening is surrounded and formed by the four sides 40*a*, to take in the granular clump material into the container 40. A lower rectangular opening is formed through a rectangular bottom wall 40*b* continuous with the four sides 40*a*, and a flexible discharge tube 41 extends downward from a central region of the bottom wall 40*b*.

In the upper region of the discharge tube 41 are provided a binder code 42, which is used to bind the upper part of the discharge tube 41 to close the outlet of the discharge tube 41.

When transporting and storing the flexible container, the upper part of the discharge tube 41 is closed by binding the binder code 42, and the discharge tube 41 is deformed or bent into contact with the bottom wall 40*b* of the container 40. When granular clump material is to be discharged from within the flexible container 40, the discharge tube 41 is stretched downward and the binder code 42 is released to open the discharge opening of the discharge tube 41.

The flexible container 40 is provided with two hanger belts 45 with which the container 40 is hung.

One hanger belt 45 has its ends sewed on two end portions of the upper edge of the front lateral side 40*a* of the flexible container 40, while the other hanger belt 45 has its ends sewed on two end portions of the upper edge of the rear lateral side 40*a* of the flexible container 40.

These two hanger belts 45 are passed on the hook 30 to hang the flexible container 40 containing granular clump material at a position above the contact units 10.

Below the table feeder 2 of the device 1 for crushing and discharging a granular clump material is put a flexible canvas hopper 50 with a cone-shaped bottom, and a discharge pipe 2*a* extends downward from the table feeder 2 into the canvas hopper 50.

How the crushing and discharging device 1 as described above operates will be described with reference to FIGS. 4 to 13. These figures are sets of a front view and a plan view showing the operation of the crushing and discharging device 1 in the order of operational stages thereof.

In the front views (FIGS. 4, 6, 8, 10 and 12), the contact unit 10 in the front is removed to provide a clear front view of the flexible discharge tube 41 extending downward from the bottom wall 40*b* and of the circular-cylindrical hopper 25. It will be understood that the removed front contact unit 10 has a structure symmetrical with the rear contact unit 10 with respect to the front-to-rear direction and operates in a similar way to the rear contact unit 10 in symmetrical fashion.

In these figures, lattice-like broken line hatchings are applied to the flexible container 40 and the discharge tube 41.

Figure 4:
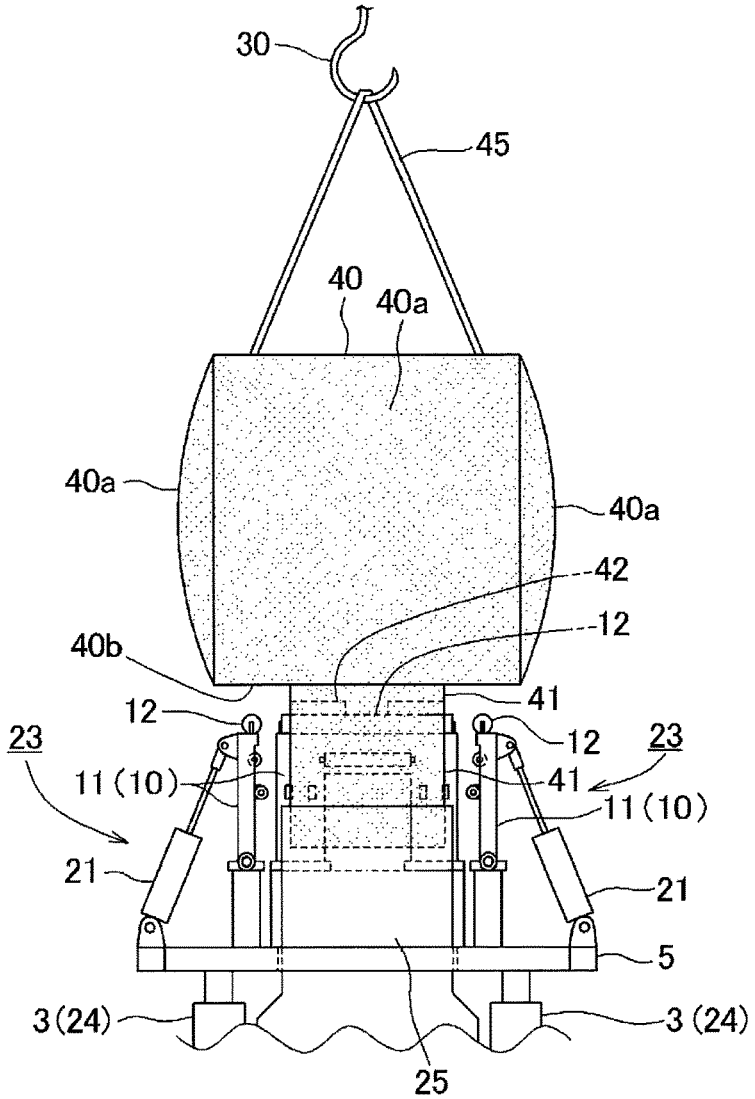
FIG. 4 is a front view of the device for crushing and discharging a granular clump material in an operational stage in which the flexible container is hung down and a crushing operation is about to be carried out.

FIG. 4 shows the same operational stage as that shown in FIG. 1. In this operational stage, the flexible container 40 containing a granular clump material therein is hung on the hook 30 at a height level above the front, rear, left and right contact units 10 located on the lift table 5, which is at a lowered position. This is a hanging step.

In this hanging step, all the front, rear, left and right contact units 10 are in the closed attitudes in which all the swing plates 11 are in vertically extending upright attitudes.

Then, the discharge tube 41 connected to the central region of the bottom wall 40*b* of the flexible container is stretched downward and inserted into the upper opening of the circular-cylindrical hopper 25. The binder code 42 is then untied to open the discharge opening of the discharge tube 41.

Even when the discharge opening of the discharge tube 41 is opened, the granular clump material in the flexible container 40 is not discharged automatically because the granular clump material is compacted and solidified.

In this state, the air cylinders 3 are operated to raise the lift table 5 and the front, rear, left and right contact units 10 on the lift table 5.

As a result, the four thrusting rods 12 in rectangular arrangement, which are on the top portions of the front, rear, left and right contact units 10 in closed attitudes, are caused to be moved and thrust against the bottom wall 40*b* of the flexible container 40.

The four thrusting rods 12 are moved and struck against the bottom wall 40*b* of the flexible container 40 in regions adjoining the front, rear, left and right outer edges of the discharge tube 41, whereby the granular clump material in the flexible container 40 is subjected to shocks and impacts in its bottom region. This creates cracks in the granular clump material, and the cracks lead to crushing of the material.

The front, rear, left and right contact units 10, which have been thrust up against the bottom wall 40*b* of the flexible container 40, are then lowered apart from the bottom wall 40*b*, and are thereafter raised again to be thrust against the bottom wall 40*b*. Such raising and lowering operation is repeated several times and completed. This is a thrusting step.

The thrusting step is useful in promoting crushing of the granular clump material by repetitively thrusting up the bottom wall 40*b* of the flexible container 40 by means of the front, rear, left and right contact units 10 taking the closed attitudes.

Cracks initially produced in the granular clump material in the flexible container 40 gradually develop upward, extending from the regions of the bottom wall 40*b* corresponding to the regions of the front, rear, left and right outer edges of the discharge tube 41. Cracks developing as a result of the thrusting operation of the four thrusting rods 12 in rectangular arrangement against the bottom wall 40*b* of the flexible container are, for example, as indicated by reference characters c shown in FIGS. 6 and 7.

Figure 7:
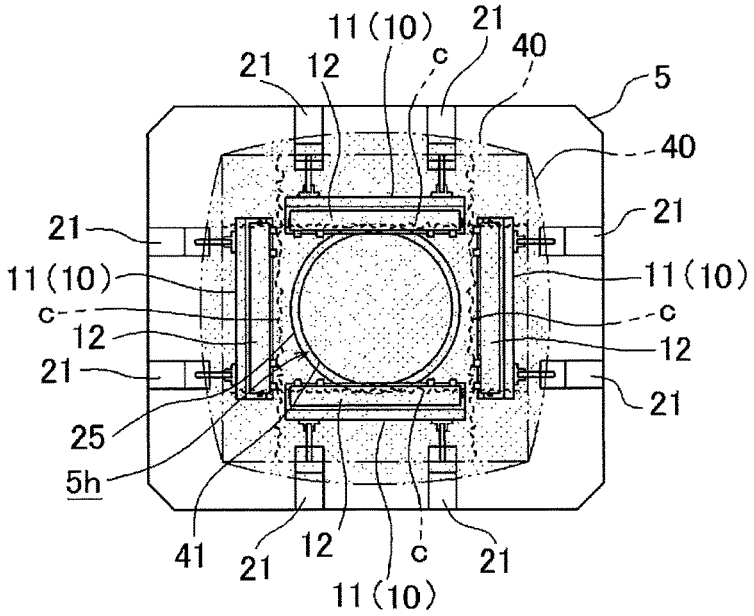
FIG. 7 is a plan view of the device for crushing and discharging a granular clump material in the thrusting stage.

The granular clump material, as indicated by the two-dot chain lines in the plan view of FIG. 7, in the flexible container 40 are thrust up by the four thrusting rods 12 against the container bottom wall 40*b* in the regions where the front, rear, left and right sides of the discharge tube 41 extend from the container bottom wall 40*a*. The cracks c shown develop upward from the regions against which the four thrusting rods 12 are thrust. The cracks c divide the mass of the granular clump material into nine blocks consisting of three front-to rear rows of blocks and three left-to-right rows of blocks as viewed in plan view.

Crushing of the granular clump material proceeds in each of the blocks, and the crushed material in the central block is first discharged or drop through the discharge tube 41 in the center of the container bottom wall 40*b*.

As the thrusting operation by the thrusting rods 12 is repeated against the container bottom wall 40*b*, crushed material in the central block is first discharged, and then clump material masses in the front, rear, left and right four blocks surrounding the central block are induced to move into the vacant central block and discharged through the discharge tube 41.

Figure 8:
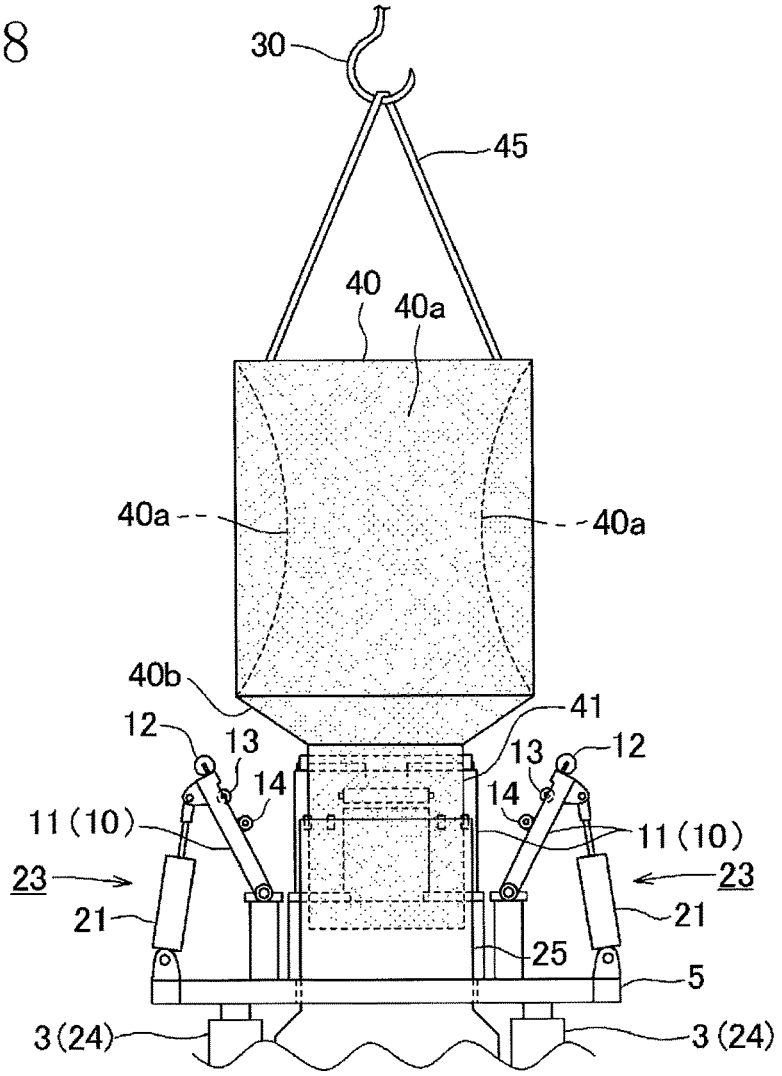
FIG. 8 is a front view of the device for crushing and discharging a granular clump material immediately before a pushing stage.
Figure 9:
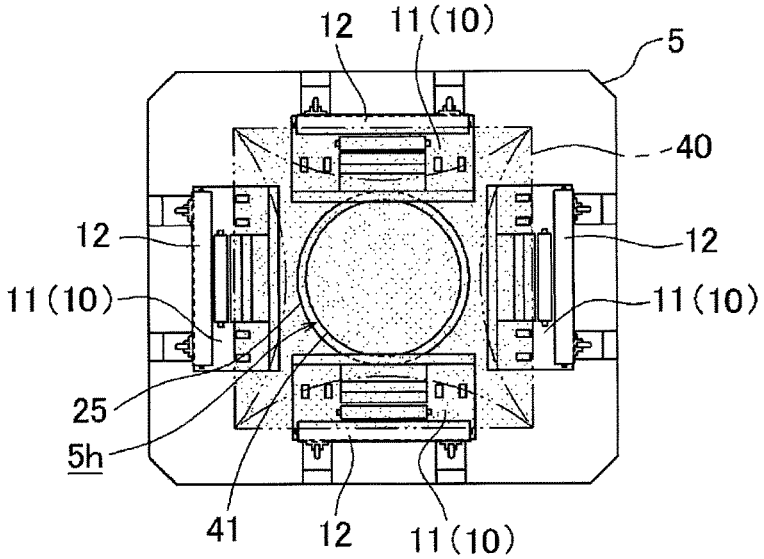
FIG. 9 is a plan view of the device for crushing and discharging a granular clump material immediately before the pushing stage.

Therefore, when the thrusting step is completed, crushed material mass in the central block and crushed material masses in the front, rear, left and right four blocks adjoining the central block are discharged through the discharge tube 41, with clump material masses remaining only in the four bottom corner parts of the container. More particularly, as shown in FIGS. 8 and 9, the flexible container 40 is entirely in a shrunk shape in which the front, rear, left and right sides 40*a* thereof are in an inwardly concave state with the four bottom corners of the container 40 protruding outwardly, while the central part of the container bottom wall 40*b* is deformed downwardly into a funnel shape, accompanied by downward stretch of the discharge tube 41. When the thrusting step is completed, the air cylinders 21 are operated to retreat the cylinder rods 21*r*, and, as shown in FIG. 8, the swing plates 11 of the contact units 10 are swung by the air cylinders 21 to the open attitudes in which the upper edges of the swing plates 11 are shifted outward.

Clump material masses still remain in the four corners of the container 40. Therefore, a pushing step (shown in FIGS. 10 to 13) is carried out in which the contact units 10 are moved from the open attitudes against the sides of the flexible container 40 in inclined oblique directions to push the flexible container sides, by gradually moving the opposing pairs of the contact units 10 toward each other into the closed attitudes while elevating or raising the contact units 10.

Figure 10:
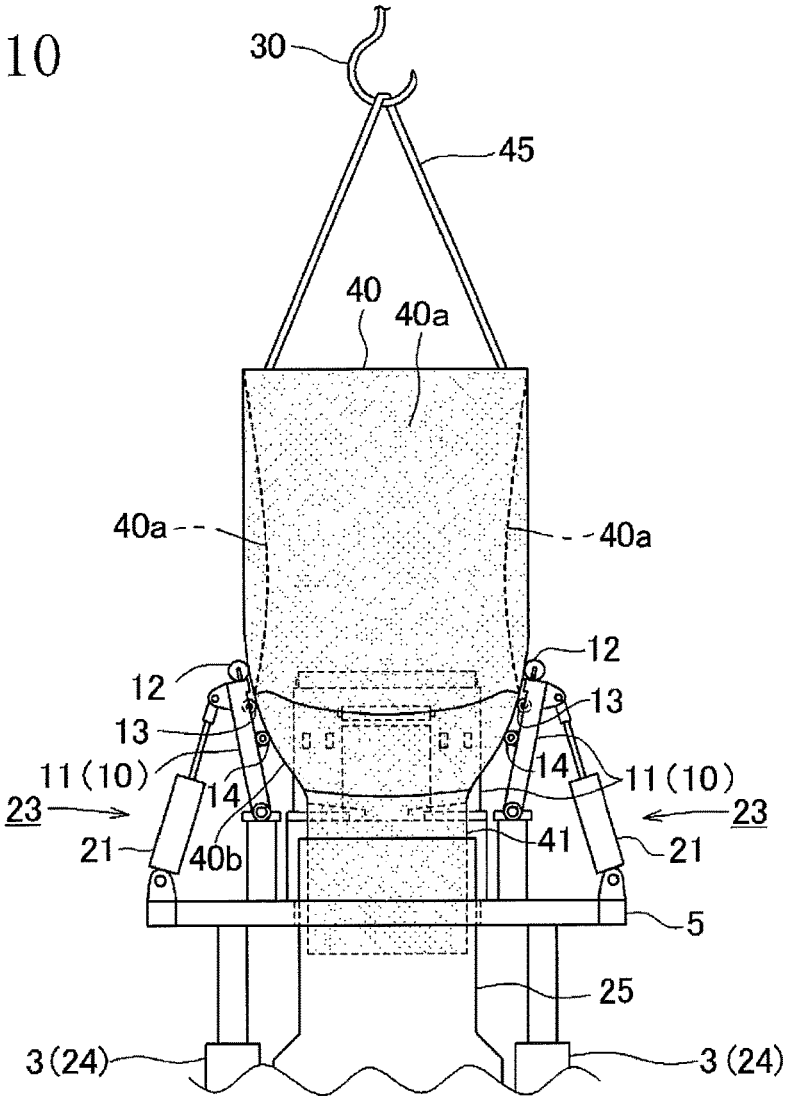
FIG. 10 is a front view of the device for crushing and discharging a granular clump material in the pushing stage.
Figure 11:
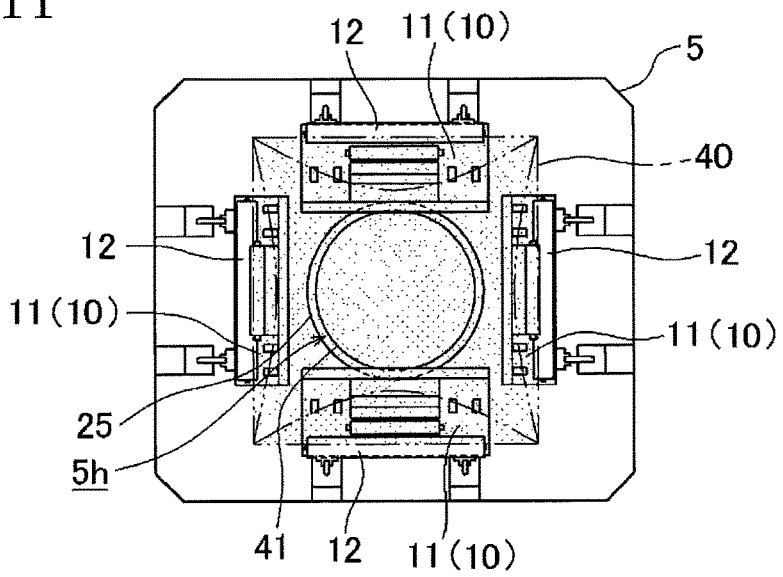
FIG. 11 is a plan view of the device for crushing and discharging a granular clump material in the pushing stage.

As shown in FIGS. 10 and 11, the pair of the front and rear contact units 10 are initially in the inclined or opened attitudes. In this state, the lift table 5 is raised while the pair of the left and right contact units 10 are being moved from the inclined or opened attitudes toward the erected or closed attitudes. During this operation, the thrusting rod 12, the elongated pressing roller 13 and the short pressing rollers 14 on the pair of the left and right contact units 10, are caused to move upward and abut, in inclined attitudes, with the flexible container 40 in the boundary regions between the funnel-shaped bottom wall 40*b* and the left and right sides 40*a* of the flexible container 40, so that the lower part of the flexible container 40 is subjected to an upwardly directed squeezing action to the left and right sides.

For this reason, the outwardly protruding four bottom corners of the flexible container 40, which corners have been somewhat deformed inwardly by the pushing step, are subjected to pressing actions from below and from the left and right sides toward the center. Consequently, clump material masses remaining in the corners are caused to be moved from the left and right sides to the center, so that the clump material masses are permitted to flow downward through the funnel-shaped bottom wall 40*b* and then discharged through the discharge tube 41.

Figure 12:
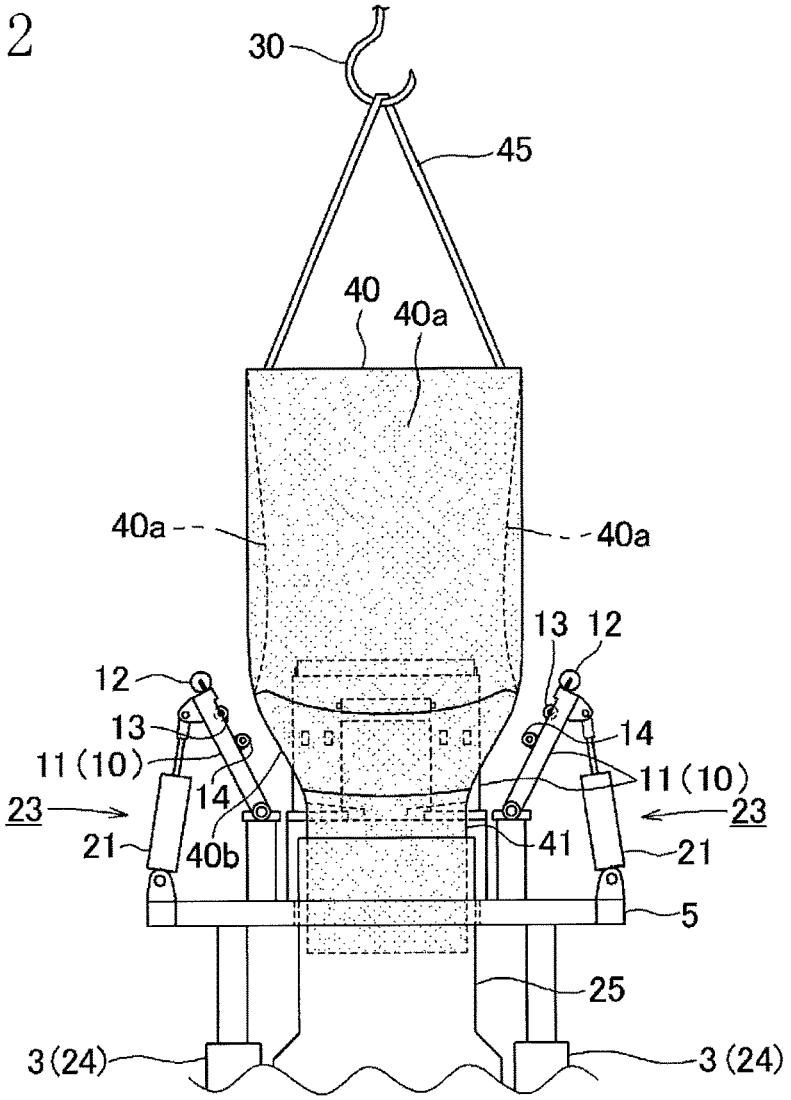
FIG. 12 is a front view of the device for crushing and discharging a granular clump material in a different operational condition in the pushing stage.
Figure 13:
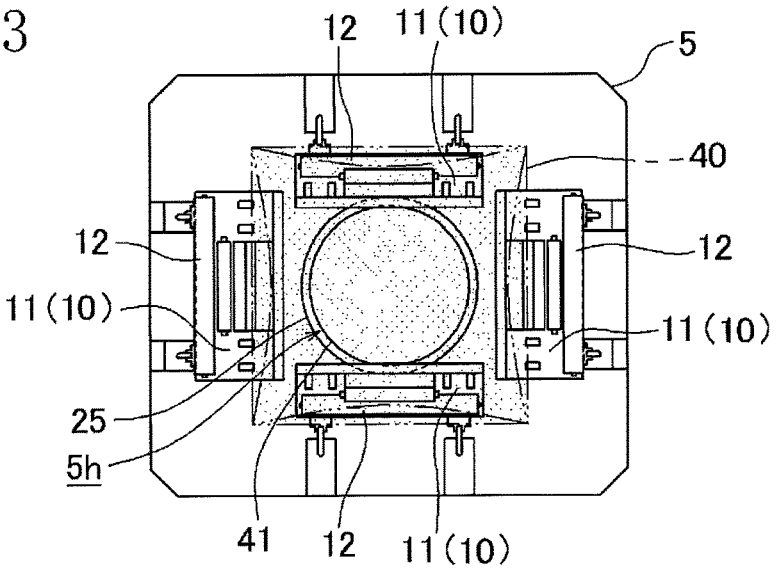
FIG. 13 is a plan view of the device for crushing and discharging a granular clump material in the different operational condition in the pushing stage.

Thereafter, as shown in FIGS. 12 and 13, the pair of the left and right contact units 10 are moved to the inclined or opened attitudes, and the front and rear contact units 10 are moved toward the erected or closed attitudes. The front and rear contact units 10 are raised while being moved toward the erected or closed attitudes. During this operation, the thrusting rod 12, the elongated pressing roller 13 and the short pressing rollers 14 on the pair of the front and rear contact units 10, are caused to move upward and abut, in inclined attitudes, with the flexible container 40 in the boundary regions between the funnel-shaped bottom wall 40*b* and the front and rear sides 40*a* of the flexible container 40, so that the lower part of the flexible container 40 is subjected to an upwardly directed squeezing action to the front and rear sides.

Therefore, the outwardly protruding four bottom corners of the flexible container 40 are subjected to pressing actions from below and from the front and rear sides toward the center. Consequently, clump material masses remaining in the corners are caused to be moved from the front and rear sides toward the center, so that the clump material masses are permitted to flow down through the funnel-shaped bottom wall 40*b* and then discharged through the discharge tube 41.

When the pushing step of forcing the clump material in the flexible container 40 by means of the pair of the left and right contact units 10 and the pushing step of forcing the clump material in the container 40 by means of the pair of the front and rear contact units 10 are carried out alternately and a plurality of times, clump material masses remaining in the four corners of the flexible container 40 are discharged repetitively through the discharge tube 41. When the pushing step thus performed repetitively is completed, substantially full amount of the clump material in the flexible container 40 is crushed and discharged through the discharge tube 41.

It will be understood that the above-described steps obviate the need for manual crushing of granular clump material and provide a safe crushing operation with a high dust collecting effect.

The discharge tube 41 extending downward from the central region of the container bottom wall 40*b* is inserted into the upper opening of the cylindrical hopper 25. Therefore, crushed material discharged through the discharge tube 41 drops onto the table feeder 2 through the cylindrical hopper 25 and is conveyed into the canvas hoper 50 through the discharge pipe 2*a*.

Crushing operation is performed in the table feeder 2 if there remains clump material therein.

The flexible container 40 used in the above-described embodiment has no inner bag therein. However, a flexible container having an inner bag can also be used in the granular clump material crushing and discharging device 1.

When the pushing step is performed after the thrusting step with the use of the flexible container with an inner bag, the inner bag is forced to be drawn by the downward flow of the crushed material at a time when the pushing step is going to be completed, with a result that the inner bag is hung down from within the flexible container and finally leaves the flexible container to drop off the flexible container.

Substantially entire crushed material continues to be discharged through the discharge tube 41 until the inner bag drops off the flexible container.

If a net is installed below the lower opening of the cylindrical hopper 25, the inner bag that has dropped can be collected by trapping the inner bag by the net.

REFERENCE CHARACTERS

1 . . . Device for crushing and discharging granular clump material, 2 . . . Table feeder, 3 . . . Air cylinder, 5 . . . Lift table, 6 . . . Vertical wall, 7 . . . Pivot pin, 10 . . . Contact unit, 11 . . . Swing plate, 12 . . . Thrusting rod, 13 . . . Elongated pressing roller, 14 . . . Short pressing roller, 20 . . . Pivot pin, 21 . . . Air cylinder, 22 . . . Pivot pin, 23 . . . Swing mechanism, 24 . . . Lift mechanism, 25 . . . Cylindrical hopper, 30 . . . Hook, 40 . . . Flexible container, 41 . . . Discharge tube, 42 . . . Binder code, 45 . . . Hanger belt, 50 . . . Canvas hopper.

The invention claimed is:

1. A method for crushing and discharging a granular clump material comprising the steps of:

hanging down a flexible container containing the granular clump material and having a bottom wall with a discharge tube extending downward from a central region of the bottom wall;

providing opposing pairs of contact units below the bottom wall and outside the discharge tube of the flexible container, the contact units including upstanding swing plates, respectively, which have respective thrusting portions along horizontal upper ends thereof and which arc swingable between vertically extending upright attitudes and open attitudes in which the swing plates are swung horizontally outward with the thrusting portions moved away outward from the flexible container;

moving the swing plates of the contact units to the open attitudes in which the swing plates are swung horizontally outward from the flexible container; and then raising the contact units relative to the flexible container while the swing plates are being swung horizontally inward relative to the flexible container to cause the swing plates to be pressed to the flexible container against portions of the flexible container in regions from the bottom wall to side walls of the flexible container, thereby to force the granular clump material in peripheral regions of the flexible container toward a central region of the flexible container to be discharged through the discharge tube, wherein, prior to the steps of moving and raising the contact units, the swing plates are swung to the vertically extending upright attitudes, respectively, and moved upward while the swing plates are at the vertically extending upright attitudes to cause the thrusting portions to be thrust vertically upward top against the bottom wall of the flexible container in regions of the bottom wall adjoining the discharge tube, thereby to crack and disintegrate the granular clump material and to cause the granular clump material in the central region of the flexible container to fall to be discharged through the discharge tube.

2. The method for crushing and discharging a granular clump material according to claim 1, wherein the step of raising the contact units relative to the flexible container while the swing plates are being swung horizontally inward toward the flexible container and the step, in which the swing plates arc swung to the vertically extending upright attitudes, respectively and moved upward while the swing plates are at the vertically extending upright attitudes to cause the thrusting portions to be thrust vertically upward against the bottom wall, are performed respectively a plurality of times.

* * * * *